US006139222A

United States Patent [19]

Hains

[11] Patent Number: 6,139,222

[45] Date of Patent: Oct. 31, 2000

[54] METHOD AND APPARATUS FOR CONTAINMENT OF OR PROTECTION FROM HAZARDOUS OR UNDESIRABLE MATERIALS

[76] Inventor: Joseph Edward Hains, 7244 Braun Ct., Arvada, Colo. 80005

[21] Appl. No.: 08/890,786

[22] Filed: Jul. 11, 1997

[51] Int. Cl.[7] ..... B21F 9/36; B08B 1/00

[52] U.S. Cl. ..... 405/54; 405/128; 588/16; 588/260; 588/900

[58] Field of Search ..... 405/52, 303, 54, 405/128; 588/1, 16, 249, 260, 261, 900

[56] References Cited

U.S. PATENT DOCUMENTS 5,461,845 10/1995 Yeager ..... 53/451

*Primary Examiner*—Eileen D. Lillis
*Assistant Examiner*—Tara L. Mayo
*Attorney, Agent, or Firm*—Pittenger & Smith, P.C.

[57] ABSTRACT

A method and apparatus for containing and protecting oblong and odd-sized objects with plastic sheeting that may form a cylindrical enclosure by pressure sealing extruded plastic profile fasteners located at opposing edges of the plastic sheet.

The open ends of the cylindrical enclosure may closed by folding the sheeting at the ends and sealing it with duct tape, or the ends may be left open, thus allowing several sections of sheeting to be placed adjacent to each other to enclose an object that exceeds the width of the sheeting. The fasteners may be tinted with different colors to provide color coded pressure closable seals that provide information about the article or material enclosed. By using different color combinations, the color of pressure seal may indicate whether the plastic sheeting is protecting non-hazardous material or containing hazardous material, or indicate the type of contained hazardous material.

5 Claims, 2 Drawing Sheets

METHOD AND APPARATUS FOR CONTAINMENT OF OR PROTECTION FROM HAZARDOUS OR UNDESIRABLE MATERIALS

FIELD OF THE INVENTION

The present invention relates broadly to an improved method and apparatus for handling hazardous, contaminated, or otherwise undesirable materials. More particularly, the invention relates to an improved manner in which sheeting may be placed around objects of various sizes and dimensions and sealed with a reclosable fasteners integrated into the sheeting.

BACKGROUND OF THE INVENTION

Cleanup of hazardous materials requires enormous amount of labor intensive material handling. Handling and disposal of toxic or radioactive material requires a high degree of compartmentalization. Dismantling or upgrading a facility that produces or processes such material necessitates the highest degree of care. Because the difficulty and high cost of handling and storing hazardous material, it is imperative that hazardous material and related fixtures do not contact non-hazardous materials and fixtures, thus minimizing the amount of hazardous material requiring disposal. The removal of fixtures dedicated to handling hazardous material requires the construction of visquine walls to protect nearby non-hazardous fixtures from contamination. Similar protection efforts entail wrapping or otherwise surrounding the non-hazardous fixtures with plastic sheeting, and sealing the plastic sheeting with duct tape. Without such protective measures, radioactive or toxic material could permeate drainage or sewage facilities, or otherwise contaminate water supplies shared with a neighboring geographical area.

In addition to protecting the non-hazardous material from the hazardous material, cleanup also requires hazardous material to be contained before it is removed. As an example, plumbing used to transport toxic or radioactive liquid must be placed in a sealed container, just as the transported liquid must be sealed. While hazardous liquid may be easily placed in sealed drums, vast lengths of pipe require a different solution. Plastic sheeting is used again, and the plumbing is wrapped or otherwise surrounded and sealed with duct tape. In most cleanup applications requiring plastic sheeting, the processes of cutting, applying and sealing the plastic sheeting are very time consuming and require at least two people, thus incurring high labor costs.

The science of material handling has long included plastic bags with pressure closable fastenings. Conventional pressure closable bags comprise a rectangular sheet of plastic folded in half, bonded on one side to form a side seam, and bonded across the bottom edge to form a cross seam. The remaining open end of the bag is sealed by pressure closable fasteners which are extruded plastic fastening strips integrated along the fourth edge that interlock when brought into contact with each other under pressure. Pressure closable fasteners are useful as they provide a quick, convenient method of forming a waterproof and airtight seal. The art of making reclosable plastic bags incorporating extruded plastic profile fasteners has developed over several decades, with many useful improvements being made. Color coding, or providing two opposing extruded plastic profile fasteners of different colors that produce a third color when sealed, provides a clear indication of whether the bag is sealed, or whether the extruded plastic fasteners are not interlocked.

While the seal of the pressure closable plastic bag would be very useful if it could be employed in hazardous waste cleanup as described above, plastic bags of the prior art are not convenient to such an application. Existing pressure closable plastic bags cannot be used to protect or contain oblong articles, such as tubes, pipes, or plumbing fixtures, because they contain only one opening and generally enclose only limited volume. In order to protect or contain oblong articles, the pressure closable seal must be incorporated into a cylindrical enclosure having open ends. There is a pressing need for plastic sheeting that incorporates the extruded plastic profile fasteners on opposite ends of a rectangular sheet to provide a quick and convenient facility for containing or shielding oblong or odd-sized objects in a sealed environment.

SUMMARY OF THE INVENTION

According to the present invention, the foregoing and other objects and advantages are attained by providing a method and apparatus for containing and protecting oblong and odd-sized objects with plastic sheeting that may form a cylindrical enclosure by pressure sealing extruded plastic profile fasteners located at opposing edges of the plastic sheet. The reclosable pressure seal of plastic bags is incorporated into plastic sheeting stored on a roll, thus supplying plastic sheeting with having predetermined width but variable length. In one aspect, the invention provides an improved method of material handling comprising the steps of: (1) determining the diameter of the article to be enclosed; (2) providing a spool containing plastic sheeting with extruded plastic profile fasteners incorporated on opposing edges of the plastic sheeting; (3) removing the desired length of plastic sheeting from the spool; (4) positioning the removed length of plastic sheeting around the article to be enclosed; and (5) interlocking the extruded plastic profile fasteners to seal the plastic sheeting in a cylindrical enclosure around the article. Preferably, the method includes the step of color coding the pressure closable seal to provide information about the article or material enclosed. By using different color combinations, the color of pressure seal may indicate whether the plastic sheeting is protecting non-hazardous material or containing hazardous material, or indicates the type of contained hazardous material.

In another aspect, the invention provides apparatus for improved material handling, consisting of sheeting defined by parallel and opposing edges, the edges incorporating extruded plastic profile fasteners. The sheeting encloses a volume by forming a cylindrical shape and is sealed along a longitudinal axis by interlocking the fasteners. By utilizing the pressure closable seal formed by interlocking the extruded plastic profile fasteners on opposing edges of a rectangular plastic sheet, cleanup and removal of hazardous material as described above does not require the construction of visquine walls and can be performed by one person using the present invention. In the case that articles of different dimensions are to be enclosed, spools of plastic sheeting having different widths may be used. In applications involving cleanup of hazardous material where regulations require sealing the enclosing plastic sheet with duct tape or similar material, one person can easily apply tape to the seal without requiring assistance in holding together the edges of the plastic sheet. The present invention also may used to contain hazardous materials, or protect non-hazardous materials from proximately located hazardous materials.

The present invention has a wide range of applications besides handling of hazardous materials, and may used in any situation where one article, material or substance must be segregated or isolated from another article, material or substance. Such applications may include painting, construction, or even temporary measures to keep leaky plumbing from damaging flooring, furniture, or other articles or materials located near the leak.

Other benefits and advantages of the present invention will become apparent from the following detailed description of the invention when it is considered in conjunction with the accompanying drawings.

DETAILED DESCRIPTION OF THE DRAWINGS

Figure 1:
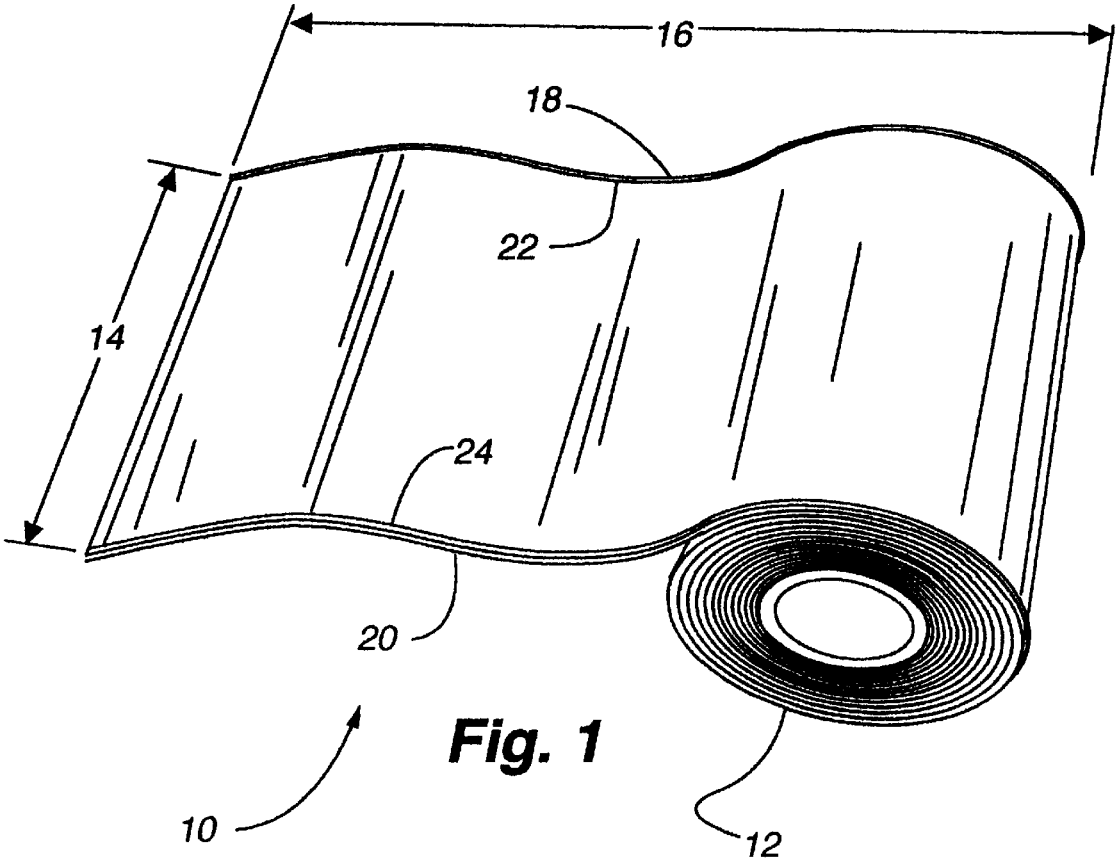
FIG. 1 shows a perspective view of the plastic sheeting incorporating extruded plastic profile fasteners along opposing edges.
Figure 2:
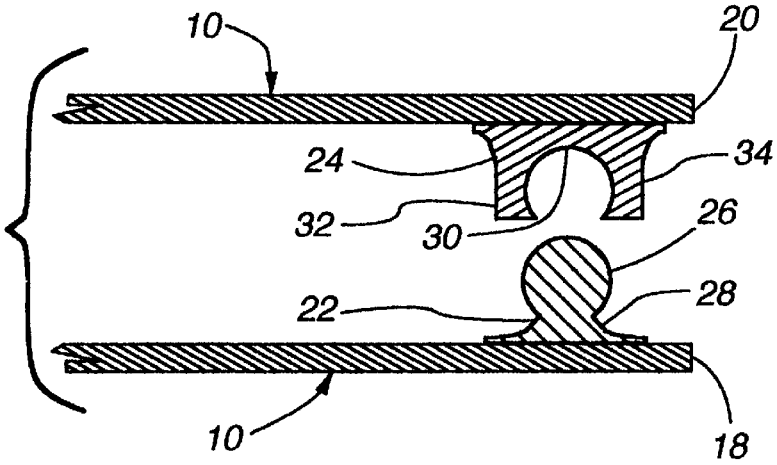
FIG. 2 shows a section view of the extruded plastic profile fasteners.

Directing attention to FIG. 1, sheeting 10 is spooled in a longitudinal orientation to form roll 12. Sheeting 10 has defined width 14, but variable length 16. Sheeting 10 is made of plastic film or similar material, with or without reinforcement and may range from approximately 1 mils to approximately 15 mils in thickness. Sheeting 10 is bordered by edge 18 and edge 20. Attached to sheeting 10 at edge 18 and running the length 16 of sheeting 10 is extruded profile fastener 22. Attached to sheeting 10 at edge 20 and running the length 16 of sheeting 10 is extruded profile fastener 24. Fasteners 22 and 24 are constructed of plastic or similar material, and are integrally fabricated into edges 18 and 20, respectively, of sheeting 10. Turning to FIG. 2, fastener 22 is constructed to interlock with fastener 24. The profile of fastener 22 is a bulbous or barbed head 26 which tapers sharply to a slender neck 28. Neck 28 protrudes perpendicularly from sheeting 10 and is integrated into sheeting 10. The profile of fastener 24 reveals flange 32 and flange 34 positioned proximate to each other to define a channel 30 of sufficient dimension to receive head 26. Flange 32 and flange 34 protrude perpendicularly from sheeting 10, and are integrated into sheeting 10. Once fastener 22 is inserted into fastener 24, flange 32 and flange 34 are pressed with sufficient force against both sides of neck 28 and against head 26 at locations 36 and 38 to retain head 26 in channel 30 (FIG. 3) in an airtight and waterproof seal. Various configurations of extruded profile fasteners are well known in the art. While extruded profile fasteners of a certain configuration has been described, other profile fasteners may be used in conjunction with the present invention.

Neck 28 and head 26 may be tinted with a certain transparent color, and flanges 32 and 34 and channel 30 may be tinted with a different transparent color. When fastener 22 is interlocked with fastener 24, the two colors blend to present a third transparent color, which indicates fastener 22 and fastener 24 are interlocked. As an example, if head 26 and neck 28 have a red tint and flanges 32 and 34 and channel 30 have a blue tint, by interlocking fastener 22 and fastener 24, a purple strip appears along the length of the seal to indicate fasteners 22 and 24 are interlocked. By incorporating different colors into fasteners 22 and 24, a color coding system can be utilized to indicate the nature of the contents enclosed in sheeting 10.

Figure 4:
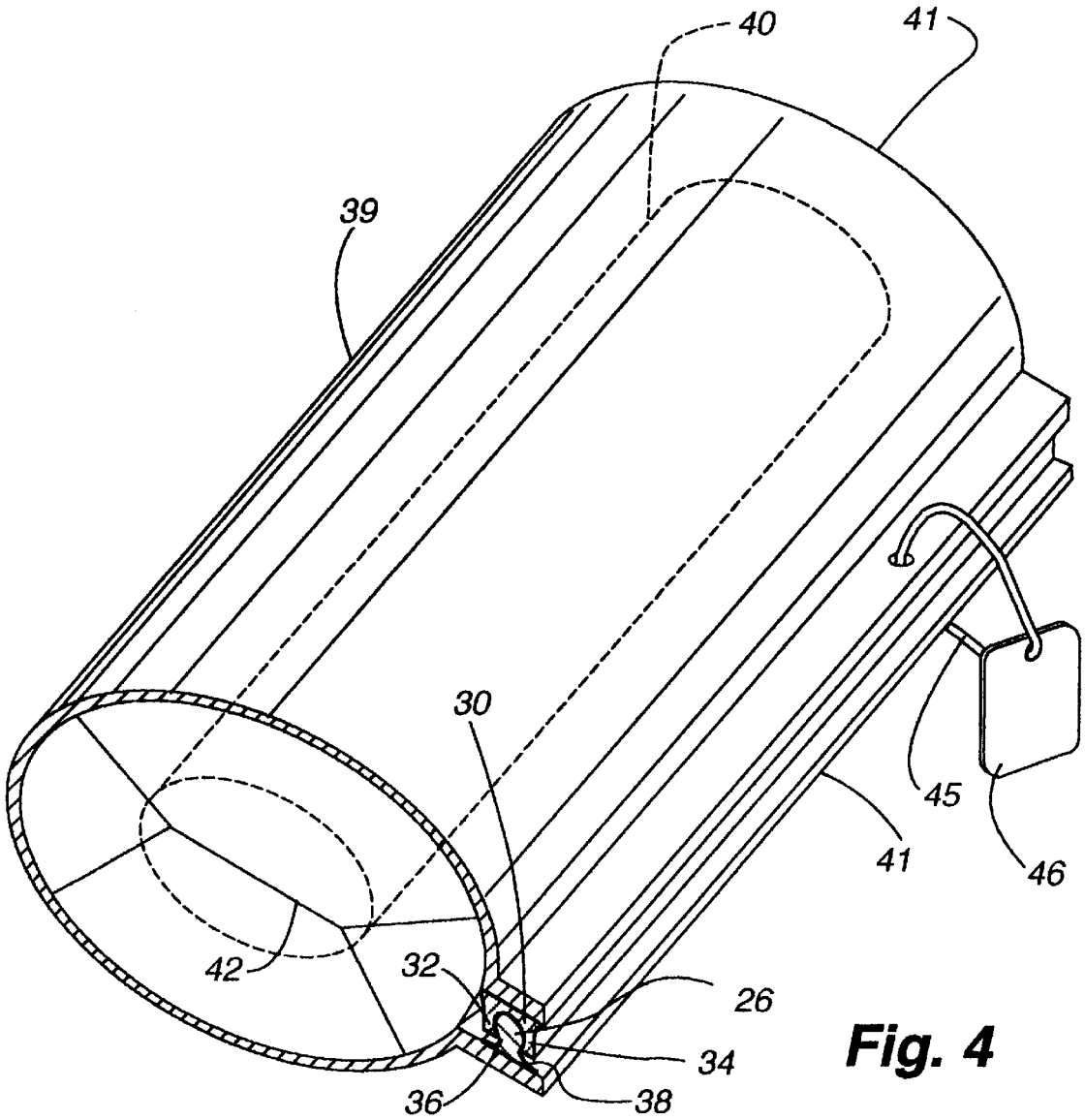
FIG. 4 shows a perspective view of the plastic sheeting of the present invention enclosing an article.

FIG. 4 shows the application of the present invention. Section 39 of sheeting 10 is removed from roll 12, and placed around an object 40. As shown in FIG. 4, object 40 is a section of pipe, but may include any oblong or odd-shaped article that is of sufficient dimension to be enclosed by sheeting 10. Edges 18 and 20 are joined together by fasteners 22 and 24 to form a seam 41, forming section 39 into a cylindrical shape with open ends 42 and 44. Depending on the application, the open ends may be closed as demonstrated at end 42. End 42 may be closed by folding the sheeting 10 at end 42 into a flat, vertical surface, and sealing end 42 with duct tape. The ends may also be left open as end 44, thus allowing several sections of sheeting to be placed adjacent to each other to enclose an object that exceeds the width 14 of sheeting 10. Seal 45 is a indication means placed through holes in sheeting 10 to surround seam 41. In the preferred embodiment, seal 45 is a section of metallic wire, and tag 46 is attached to seal 45 to provide information about the type of material enclosed, enclosure date, and the identity of the party responsible for enclosing the material.

Figure 3:
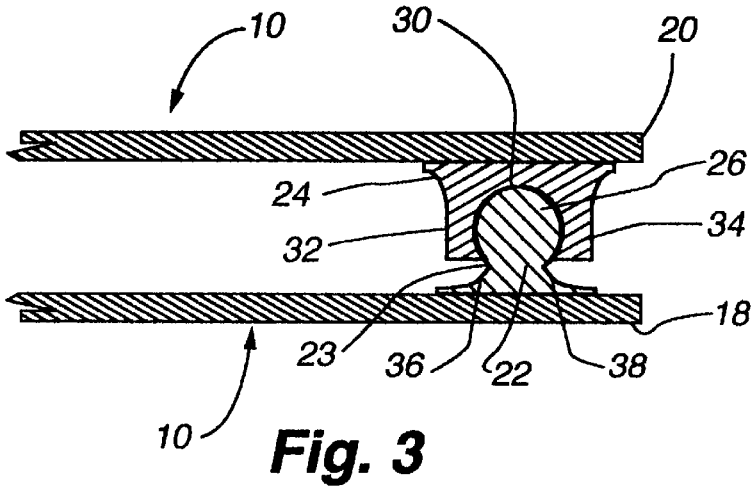
FIG. 3 shows a section view of the extruded plastic profile fasteners in an interlocked orientation.

An alternative indication means is shown in FIG. 3. Adhesive means 23 is placed between fastener 22 and fastener 24 before they are interlocked to bond fastener 22 and fastener 24 together, thus preventing inadvertent separation of the fasteners. In the preferred embodiment, adhesive means 23 may be a plasticizing paste gel or liquid, but plasticizing, adhesive tape may also be used instead. Adhesive means 23 may also be colored or labeled to indicate the nature of the enclosed material, person responsible for enclosing the contents, or other information. Adhesive means 23 provides an indication of any attempt to separate fasteners 22 and 24, as adhesive means 23 bonds with sufficient strength that any attempt to open the fasteners would be apparent from tears in sheeting 10 or fasteners 22 or 24.

While an improved method and apparatus for handling hazardous or otherwise undesirable material has been shown and described in detail in this application, it is to be understood that this invention is not to be limited to the exact form disclosed and changes in detail and construction of the various embodiments of the invention may be made without departing from the spirit thereof.

What is claimed is:

1. A method for minimizing migration or movement of contaminating or damaging substances from or to one or more materials, said method comprising the steps of:

a. providing sheeting that is resistant and impedes migration of the contaminating or damaging substance of concern having a width to completely surround said one or more materials to be separated having a first edge having a first fastening means spanning said first edge, a second edge opposing said first edge, said second edge having a second fastening means spanning said second edge;

b. determining the needed length and making the length of the sheeting long enough to extend the length of said one or more materials to be separated;

c. placing the width of said sheeting around said one or more materials to be separated so that said first edge is proximate to said second edge; and d. bringing said first fastening means into contact with said second fastening means; and e. thus forming a tubular space with the seal running the length of the tube.

2. The method of forming a tubular space as described in claim 1 wherein the fastening means is a pressure reclosable seal.

3. The method of forming a tubular space as described in claim 1, further comprising the step of including a means to indicate if the seal is a good seal and whether it has been broken since being sealed.

4. The method for forming a tubular space as described in claim 1, said space having a first open end and a second open end opposing said first open end, wherein the method is further comprised of the step of closing and sealing said first and second ends around the one or more materials to be separated.

5. An apparatus for minimizing migration and travel of contaminating or damaging substances from or to one or more materials to be separated, said apparatus comprised of:

a. a sheeting material that is resistant to and impedes migration of the contaminating or damaging substances of concern;

b. said sheeting material being wide enough to surround one or more materials to be separated;

c. said sheeting having a first edge with a first fastening means spanning said first edge, a second edge with a second fastening means spanning said second edge, with said second fastening edge opposed to said first fastening edge;

d. with the first fastening edge fastened to the second fastening edge, the sheeting forms a tubular space with the connected first and second fastening edges forming a seal that is resistant to and impedes migration of the contaminating or damaging substances of concern;

e. a wire tag indicator made part of the seal which indicates if the seal has been compromised or broken.

* * * * *